US009603768B1

(12) United States Patent
Widmer et al.

(10) Patent No.: US 9,603,768 B1
(45) Date of Patent: Mar. 28, 2017

(54) FOOT FLEXION AND EXTENSION MACHINE

(71) Applicants: Michael John Widmer, Arkansas City, KS (US); Richard David Lanning, Leawood, KS (US); Sammie Lynn Collins, Newton, KS (US)

(72) Inventors: Michael John Widmer, Arkansas City, KS (US); Richard David Lanning, Leawood, KS (US); Sammie Lynn Collins, Newton, KS (US)

(73) Assignee: MISA Technologies, L.L.C., Arkansas City, KS (US)

( * ) Notice: Subject to any disclaimer, the term of this patent is extended or adjusted under 35 U.S.C. 154(b) by 595 days.

(21) Appl. No.: 14/075,172

(22) Filed: Nov. 8, 2013

(51) Int. Cl.
*A61H 1/02* (2006.01)

(52) U.S. Cl.
CPC ..... *A61H 1/0266* (2013.01); *A61H 1/024* (2013.01)

(58) Field of Classification Search
CPC ..... A61H 1/00; A61H 1/02; A61H 1/0214; A61H 1/0237; A61H 1/0266; A61H 2001/0203; A61H 2001/0207; A61H 2201/12; A61H 2201/1207; A61H 2201/1215; A61H 2201/123; A61H 2201/14; A61H 2201/1436; A61H 2201/1481; A61H 2201/149; A61H 2201/16; A61H 2201/1602; A61H 2201/164; A61H 2201/1642; A61H 2201/1664; A61H 2201/1671; A61H 2201/1676; A61H 2201/1678; A61H 2201/50; A61H 2205/12
See application file for complete search history.

(56) References Cited

U.S. PATENT DOCUMENTS

| | | | | |
|---|---|---|---|---|
| 4,452,447 A | | 6/1984 | Lepley et al. | |
| 4,637,379 A | * | 1/1987 | Saringer | A61H 1/0259 601/34 |
| 4,665,899 A | * | 5/1987 | Farris | A61H 1/0259 601/33 |
| 4,842,265 A | | 6/1989 | Kirk | |
| 4,974,830 A | | 12/1990 | Genovese et al. | |
| 5,170,776 A | * | 12/1992 | Pecheux | A61H 1/0266 601/104 |
| 5,335,674 A | | 8/1994 | Siegler | |
| 5,352,185 A | | 10/1994 | Blauth et al. | |

(Continued)

*Primary Examiner* — Steven Douglas
(74) *Attorney, Agent, or Firm* — Kenneth H. Jack; Davis & Jack, L.L.C.

(57) ABSTRACT

An ankle flexion and extension machine including a lower leg backing beam having upper and lower ends; a support arm cantilevering from the lower leg backing beam; an arm mounting pivot joint interconnecting the lower leg backing beam's lower end and the support arm's proximal end; a foot plate; a plate mounting pivot joint interconnecting the foot plate and the support arm's distal end, the plate mounting pivot joint being adapted for facilitating dorsiflecting and plantarflecting pivoting movements of the foot plate with respect to the lower leg backing beam; a reversible electric motor connected operatively to the foot plate, the reversible electric motor being adapted for driving the pivoting movement of the foot plate; a floor support base; and a triangulating frame supporting the lower leg backing beam, the support arm and the foot plate over the floor support base.

20 Claims, 7 Drawing Sheets

(56) References Cited

U.S. PATENT DOCUMENTS 5,399,147 A * 3/1995 Kaiser ..... A61H 1/0255 601/16
5,468,217 A 11/1995 Garcia et al.
5,536,226 A 7/1996 Gordon
5,830,160 A 11/1998 Reinkensneyer
5,853,354 A 12/1998 Kubota
6,152,855 A 11/2000 Dean, Jr. et al.
6,155,993 A 12/2000 Scott
6,162,189 A 12/2000 Girone et al.
6,217,488 B1 4/2001 Bernardson
6,277,057 B1 8/2001 Hayden
6,599,255 B2 7/2003 Zhang
6,758,825 B1 7/2004 Mathew
6,878,102 B1 4/2005 Commisso
7,125,388 B1 10/2006 Reinkensneyer
7,175,602 B2 2/2007 Diaz et al.
7,309,320 B2 * 12/2007 Schmehl ..... A61H 1/024 601/31
7,481,751 B1 1/2009 Arnold
7,485,074 B2 2/2009 Chen
7,618,381 B2 11/2009 Krebs et al.
7,874,968 B2 * 1/2011 Foucault ..... A63B 21/0087 482/112
7,892,154 B1 2/2011 Alexa
8,058,233 B2 11/2011 Cowley et al.
8,177,732 B2 5/2012 Einav et al.
8,192,377 B2 6/2012 Ripperger, III
8,274,244 B2 9/2012 Horst et al.
8,287,477 B1 10/2012 Herr et al.
8,317,730 B2 11/2012 Zhang et al.
8,343,218 B2 1/2013 Lang et al.
8,353,854 B2 1/2013 Horst et al.
8,376,971 B1 2/2013 Herr et al.
8,391,954 B2 3/2013 Quaid, III
8,403,817 B2 3/2013 Ferguson et al.
2006/0069336 A1 3/2006 Krebs et al.
2010/0241037 A1 9/2010 Thomas
2012/0065030 A1 3/2012 Sandvig
2014/0088466 A1 * 3/2014 Hansen ..... A63B 21/4045 601/34
2014/0094721 A1 * 4/2014 Diallo ..... A61H 1/024 601/5

* cited by examiner

FOOT FLEXION AND EXTENSION MACHINE

FIELD OF THE INVENTION

This invention relates to physical therapy assisting apparatus. More particularly, this invention relates to such apparatus which are adapted for assisting in joint manipulation physical therapy directed to patients' feet and ankle joints.

BACKGROUND OF THE INVENTION

Professional physical therapists commonly perform foot and ankle manipulations wherein a patient's foot and ankle are manually moved and guided through flexing and extending motions between the foot's dorsiflexion and plantarflexion positions. Such physical therapy technique is commonly performed for purposes including increasing foot flexibility and increasing a foot's range of motion following a period of joint immobilization. Such manual physical therapy technique typically and inconveniently occupies both of the physical therapist's hands, and commonly imprecisely results in performance of an incorrect number of manipulations or results in performance of foot flexions and extensions having imprecise or incorrect magnitude or angular range.

The instant inventive foot flexion and extension machine advantageously solves or ameliorates the problems, drawbacks, and deficiencies of such manually performed foot and ankle physical therapy by providing specialized foot engaging and moving structures and mechanisms which automate such manual physical therapy processes.

BRIEF SUMMARY OF THE INVENTION

A first structural component of the instant inventive foot flexion and extension machine comprises a leg support beam having an upper end and lower end. In a preferred embodiment, the leg support beam is rigid, and has a length and width sufficient to provide backing support for a physical therapy patient's lower leg. Also in the preferred embodiment, the leg support beam is either box configured or "C" channel configured, the beam having a forward lower leg and calf contacting and supporting web, and the beam having a rearward opening for receiving and compactly housing a height adjusting extending and retracting mechanism.

A further structural component of the foot flexion and extension machine comprises a support arm having proximal and distal ends. In a preferred embodiment, the proximal end of the support arm is configured as a clevis whose arms are laterally spaced for receipt of and pivotal mounting upon the lower end of the leg support beam.

A further structural component of the foot flexion and extension machine comprises arm mounting means which are adapted for securely interconnecting the leg support beam's lower end and the support arm's proximal end. In a preferred embodiment, such mounting means comprise the clevis configuration of the proximal end of the support arm, and further comprise respective hinged attachments of the left and right arms of such clevis to the left and right sides of the lower end of the leg support beam. In the preferred embodiment, the arm mounting means facilitate pivotal motions of the support arm with respect to the leg support beam between a forwardly cantilevering or "L" configured use position and a compact storage position, such position preferably being dorsiflected with respect to the leg support beam.

A further structural component of the instant inventive foot flexion and extension machine comprises a foot plate which is fitted for providing firm under support of the physical therapy patient's foot. In the preferred embodiment, the foot plate is equipped with fastening means such as a heel cup and straps combination which is adapted for securely holding tarsal and metatarsal aspects of a physical therapy patient's foot upon the foot plate's upper surface. In the preferred embodiment, the distal end of the support arm is, like its proximal end, preferably configured as a clevis whose forwardly extending arms are laterally spaced for receiving and facilitating reciprocating pivoting motion of the foot plate.

A further structural component of the instant inventive foot flexion and extension machine comprise plate mounting means which are adapted for interconnecting the foot plate and support arms' distal end, the plate mounting means preferably being adapted for facilitating the reciprocating pivoting of the foot plate. In the preferred embodiment, the plate mounting means comprise the above described clevis configuration of the distal end of the support arm in combination with hinge, pivot pin, or pivot axle components which pivotally and rotatably interconnect left and right sides of the foot plate with the preferred distal left and right clevis arms of the support arm.

A further structural component of the instant inventive foot flexion and extension machine comprises first motor means which preferably operatively interconnect the foot plate and the support arm. In a preferred embodiment, the first motor means are adapted for pivoting and counter-pivoting the foot plate between dorsiflected and plantarflected positions with respect to the leg support beam. While the first motor means may suitably comprise various commonly known electric or pneumatic motors, the first motor means preferably comprise a reversible DC servomotor which is adapted for electronic control of rotational speed/power, and output shaft angular position. Such control of the preferred servomotor's output shaft may be advantageously translated by the inventive machine into precise control of the extent of foot manipulations, the number of repetitions of foot manipulations, dorsiflecting, and plantarflecting extents of foot manipulations, and the power/speed experienced by the patient's foot.

A further structural component of the instant inventive foot flexion and extension machine comprises a base which is preferably adapted for providing secure support of the leg beam, support arm, and foot plate components from a resting position upon a floor surface. Beam mounting means are preferably provided for securely mounting the leg support beam, along with its attached, arm foot plate and motor means components over the base. In the preferred embodiment, the beam mounting means comprise an assembly of pivot joints, pivot arms and braces which enable reconfigurations of the machine for compact storage and for rolling portability.

In use of the instant inventive foot flexion and extension machine, and assuming provision and incorporation of the preferred components described above, a physical therapy patient may sit at bedside with an ankle and foot in need of joint manipulation physical therapy extending downwardly. The machine may then be placed at the bedside and in close proximity with the patient so that the patient's lower leg may forwardly overlie and be supported by the front face of the leg support beam and so that the patient's foot may overlie and be directly supported by the machine's foot plate. Thereafter, the foot plate's fasteners may secure the foot to the foot plate, and the DC servomotor may be actuated for alternatively flexing and extending between the foot's dorsiflexion and plantar flexion positions. Such machine actuated foot physical therapy manipulations precisely performs foot and ankle joint manipulation physical therapy while freeing the physical therapist's hands for performance of other tasks.

Accordingly, objects of the instant invention include the provision of a foot flexion and extension machine which incorporates structures, as described above, and which arranges those structures in relation to each other, in manners as described above, for achievement of the benefits and functions, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
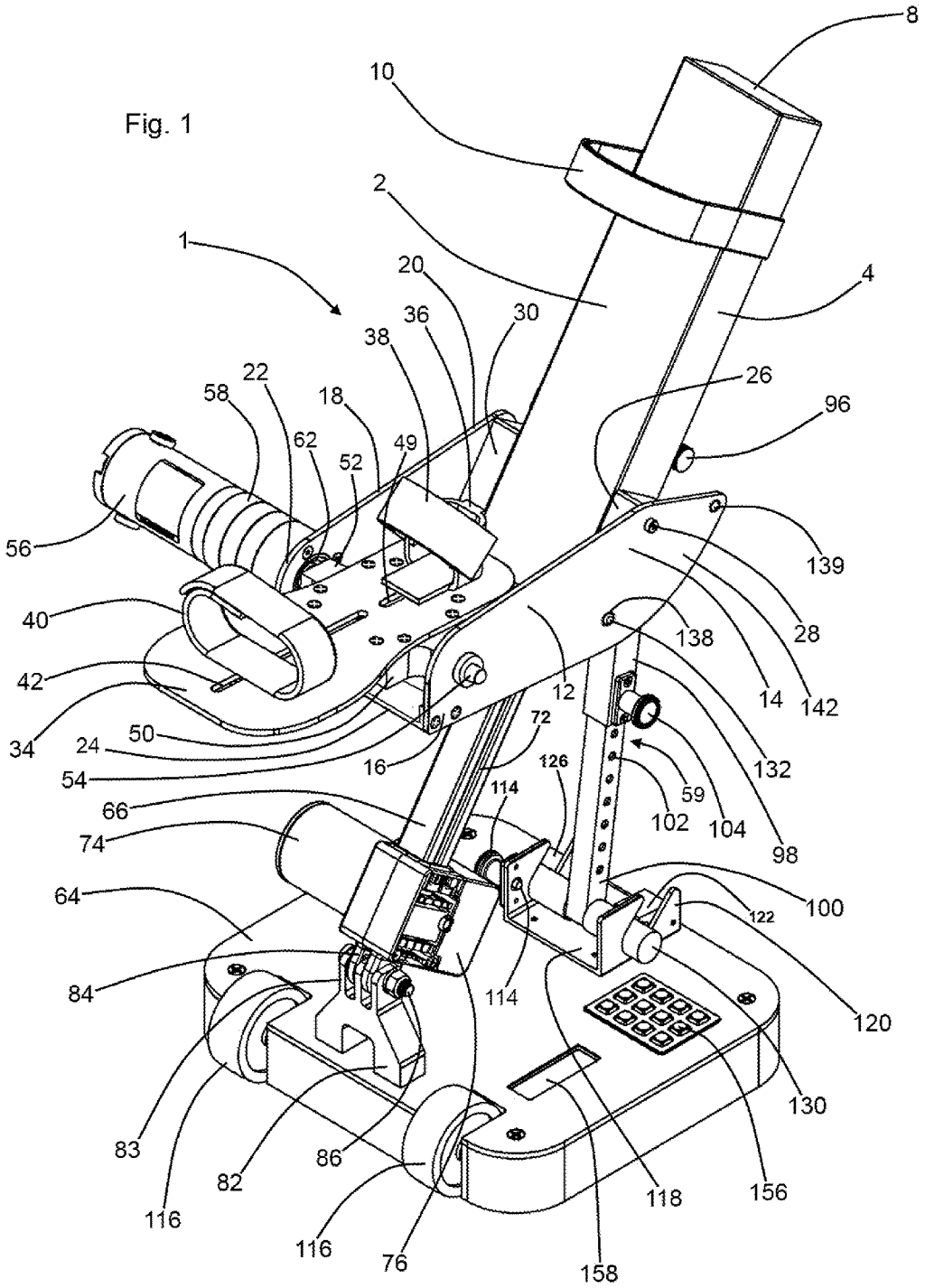
FIG. 1 is a perspective view of a preferred embodiment of the instant foot flexion and extension machine.
Figure 2:
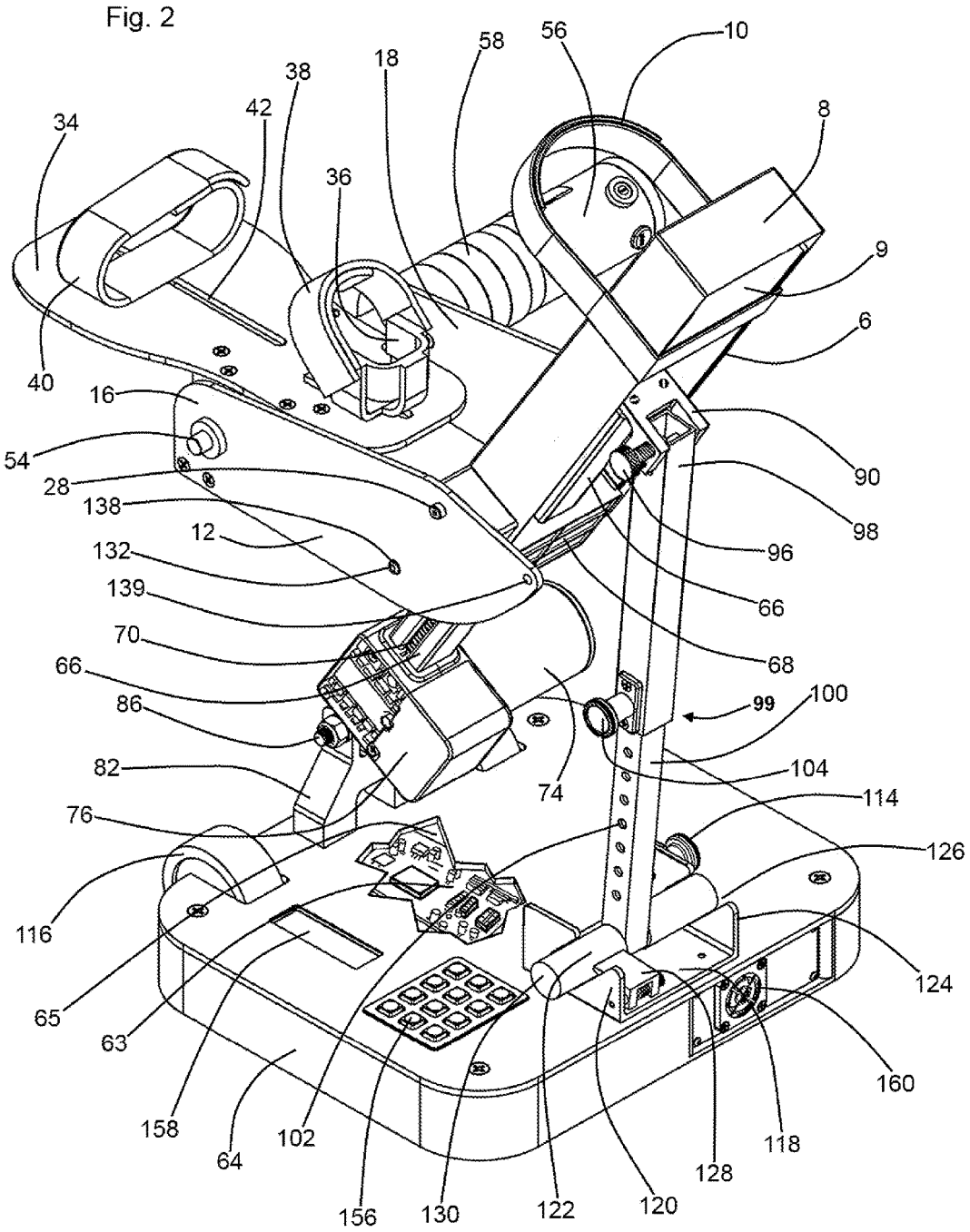
FIG. 2 is an alternative perspective view of the machine of FIG. 1, the view including a "cut away" section for exposure of internal structures.

Referring now to the drawings, and in particular simultaneously to Drawing FIGS. 1 and 2, a preferred embodiment of the instant inventive foot flexion and extension machine is referred to generally by Reference Arrow 1. The foot flexion and extension machine preferably comprises a rigid leg support beam 2, such beam having left and right side walls 4 and 6, and an upper end 8. The leg support beam 2 is preferably box or "C" channel configured to form a hollow interior 9 which preferably opens rearwardly. The vertical length of the leg support beam is preferably fitted for underlying and supporting the dorsal aspect of a physical therapy patient's lower leg. In order to securely hold such lower leg, flexible "velcro" straps 10 may be provided.

Referring further simultaneously to FIGS. 1 and 2, the instant inventive foot flexion and extension machine preferably further comprises a support arm 12,18, such arm having a proximal end 14,20 and a distal end 16,22. In the preferred embodiment, the proximal 14,20 and the distal 16,22 ends of the support arm 12,18 are configured as clevises whose arms respectively receive the lower end of the beam 2 and a foot plate 34. Distal ends 16,22 of the arm 12,18 are preferably laterally supported by a cross brace 24.

Figure 5:
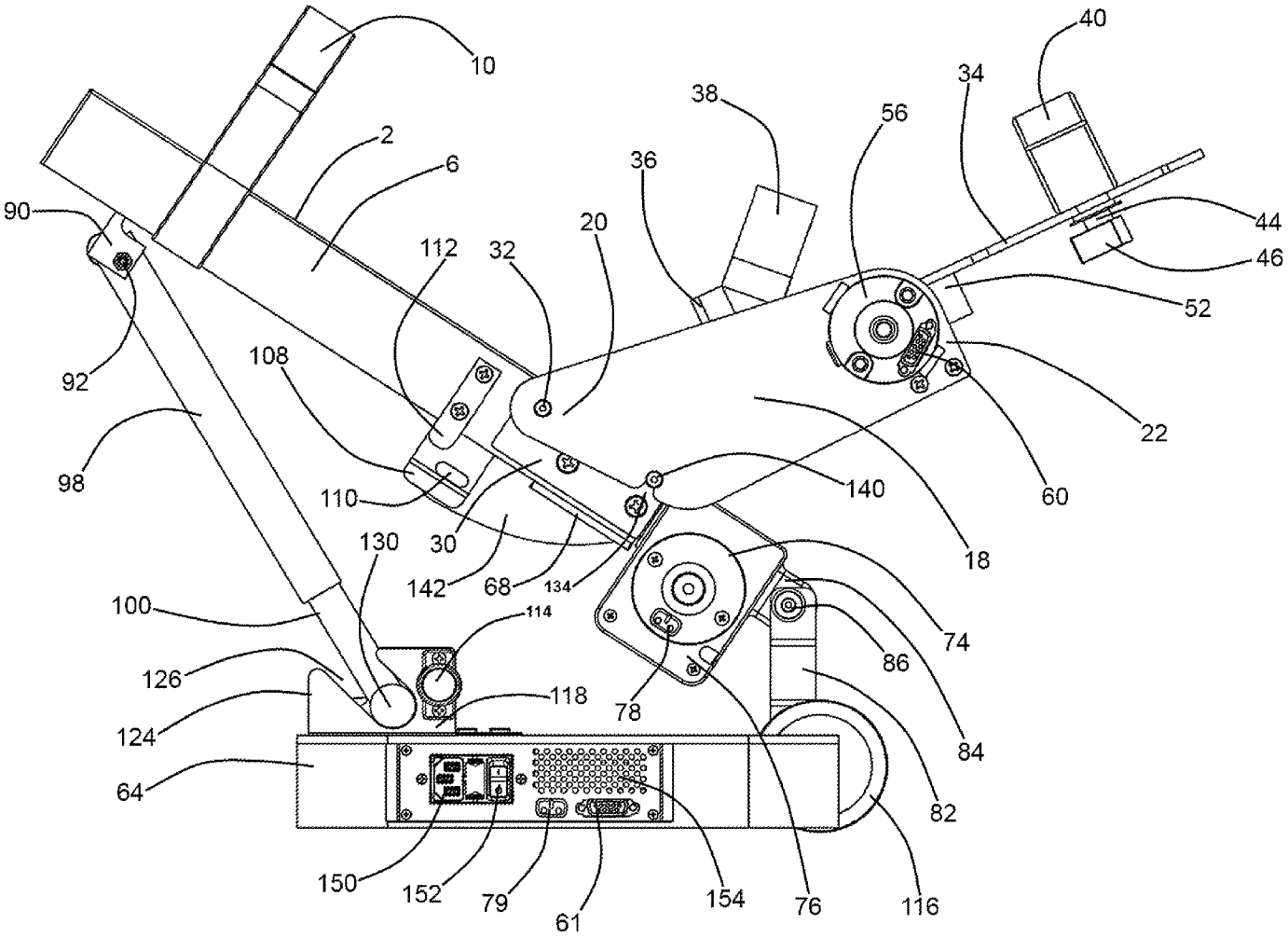
FIG. 5 is a reverse view of the machine of FIG. 3.

Arm mounting means in the form of left and right mounting blocks 26 and 30 are preferably provided, such blocks being rigidly attached to the left and right walls 4 and 6 of the leg support beam 2. Referring simultaneously to FIGS. 1 and 5, proximal ends 14 and 20 of the support arm 12,18 are respectively fixedly attached to mounting blocks 26 and 30, such fixed attachments preferably comprising pivot pins or axles 28 and 32.

Figure 7:
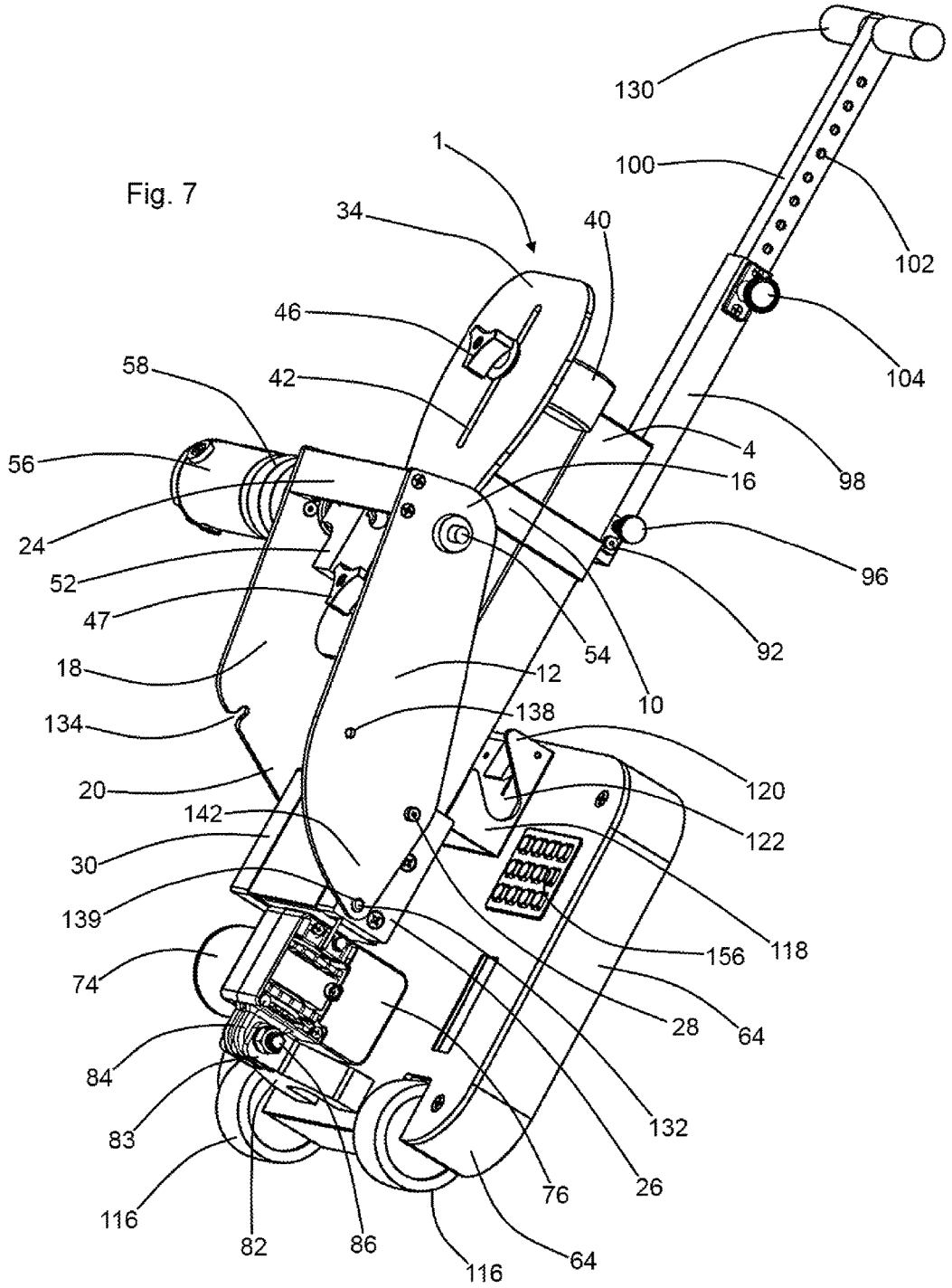
FIG. 7 redepicts the machine of FIG. 3, the view of FIG. 7 showing the machine in an alternative pull cart configuration.

Referring simultaneously to FIGS. 1 and 7, the instant inventive foot flexion and extension machine supports and operatively deploys the foot plate 34. In the preferred embodiment, the foot plate 34 is equipped with releasable fasteners which are adapted for securely holding tarsal and metatarsal aspects of a physical therapy patient's foot against the foot plate's upper surface. Such fasteners may suitably comprise a combination of a heel cup 36 and flexible "velcro" straps 38 and 40. Flexible "velcro" straps 40 is preferably variably longitudinally positionable by means of a positioning slot 42 and clamp screw 46 combination. The heel cup 36 and its "velcro" straps 38 are preferably similarly longitudinally positionable by means of a heel positioning slot 49 and clamp screw 47 combination. By manipulating the longitudinal positions of the heel cup 36 and straps 38 and 40 upon plate 34, the extension of a physical therapy patients' lower leg and the pivot axis of such patients' ankle may be advantageously aligned with the foot plate's pivot axis.

Referring simultaneously to FIGS. 1, 5, and 7, the instant inventive foot flexion and extension machine preferably further comprises plate mounting means which are adapted for securely interconnecting the foot plate 34 and the distal end 16,22 of the support arm 12,18. In the preferred embodiment, the plate mounting means comprise left and right mounting blocks 50 and 52 which are fixedly and rigidly mounted to the undersurface of the foot plate 34. Mounting block 50 supports a left journal axle 54 which rotatably engages distal end 16 of the support arm 12,18, and the right mounting block 52 in a similar fashion receives and is supported upon a rotary drive linkage 62 of an attached motor 56 and reduction gear train 58 combination. By providing such rotating or pivoting joints 54 and 62 at the junctures of the left and right blocks 50 and 52 with the arm distal ends 16 and 22, such plate mounting means advantageously facilitate the pivoting and counter-pivoting foot plate movement.

First motor means are provided for driving the pivoting and counter-pivoting movement of foot plate 34, such means comprising the motor 56 and gear train 58 combination, such combination preferably being fixedly mounted to the distal end 22 of support arm 12,18. In the preferred embodiment, the motor 56 comprises a reversible DC servomotor whose rotational speed and/or power, direction of turn, and angular extent of turns are electronically controllable. Also in the preferred embodiment, the reduction gear train 58 comprises orbital or planetary gears.

Referring to FIG. 1, a portable floor mount or base 64 is provided. Beam mounting means which are referred to generally by Reference Arrow 59 are also provided, such means serving a primary function of securely positioning the leg support beam 2, support arm 12,18, foot plate 34, and motor means 56,58 components over the base 64 during physical therapy use of the machine. During such use, a physical therapy patient may sit at bedside, and the machine 1 may be positioned with its base 64 upon the floor in close proximity with the patient. Thereafter, flexible "velcro" straps 10, 38, and 40 may be utilized for securely holding the patient's lower leg against leg support beam 2 and for securely holding the patient's foot against foot plate 34. Thereafter, the reversible DC electric motor 56 may be actuated to successively pivot and counter-pivot the foot plate 34, such pivoting and counter-pivoting motion advantageously successively flexing and extending the patient's foot between dorsiflected and plantarflected positions. Accordingly, ankle joint range of motion enhancing physical therapy may be automatically provided by the machine to the patient's foot and ankle while the physical therapist operator of the machine is freed to perform other tasks.

Referring simultaneously to FIGS. 1 and 2, in order to enable the machine 1 to accommodate physical therapy patients having various heights, and to accommodate various patient seating heights, the instant inventive foot flexion and extension machine preferably further comprises height adjusting means which are adapted for alternatively upwardly and downwardly moving the leg support beam 2, support arm 12,18, and foot plate 34, with respect to the base 64 and the floor. In a preferred embodiment, such height adjusting means comprise a slide shaft 66 and slide sleeve 68 combination. The lower end of the slide shaft 66 is preferably fixedly attached to the forward end of the base 64, and the upper extension of the slide sleeve 68 is preferably securely mounted to the leg support beam 2 for reciprocating extensions and retractions into and out of the leg beam's rearwardly opening space 9. Though such extensions and retractions may suitably be facilitated by a simple sliding joint in combination with a pin and alignable eyes fastener (similar to that of telescoping shaft 98,100), the instant invention's height adjusting means preferably comprise a linear motion actuator which operatively moves the leg support beam 2 along slide shaft 66. A preferred linear motion actuator preferably comprises a jack screw assembly whose screw 70 is mounted rotatably within slide shaft 66. The helical threads of such screw 70 are preferably laterally exposed along vertically extending side wall slots 72, and an internally threaded coupling nut housed within slide sleeve 68 threadedly engages screw 70.

Screw 70 may suitably be manually turnable for impelling the adjustable upward and downward motions of the leg support beam 2, support arm 12,18 and the foot plate 34. However, such motion is advantageously automatically powered by second motor means which preferably comprises a second reversible DC electric motor 74. Rotary power from motor 74 is translated to the screw 70 via a second reduction gear train housed within gear box 76, such box preferably multiply functioning as a mounting structure interlinking the motor 74, the lower end of slide shaft 67, and the base 64. Referring simultaneously to FIGS. 1 and 2, rotation and counter-rotation of the DC electric motor 74 operates to turn and counter-turn the screw 70 within slide shaft 66, such screw rotation engaging internal helical threads within slide sleeve housing 68 for upwardly and downwardly moving the slide sleeve 68, leg support beam 2 which is rigidly attached to slide sleeve 68, arm 12,18, and the foot plate 34 over the base 64.

Figure 6:
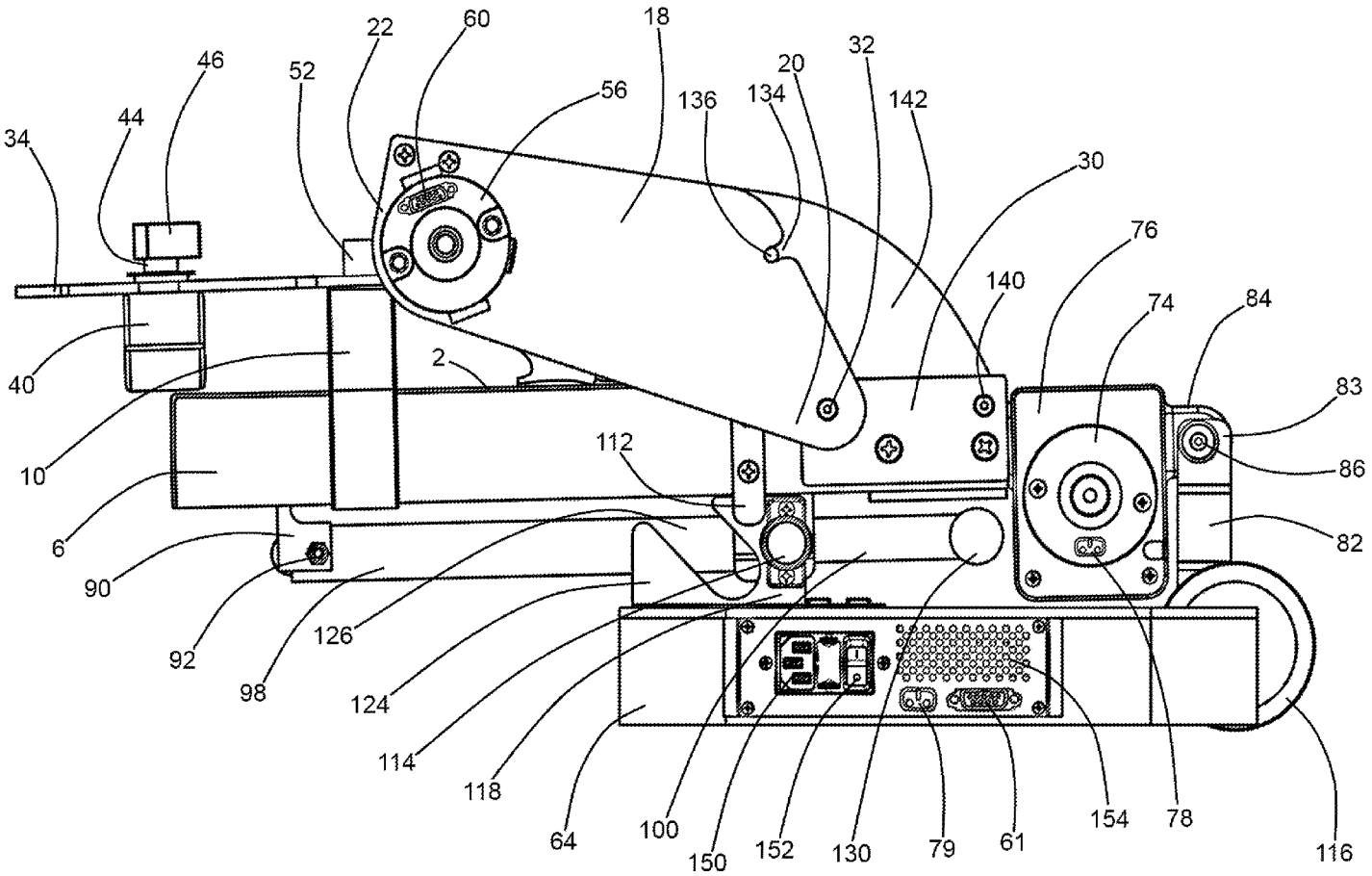
FIG. 6 redepicts the machine of FIG. 5, the view of FIG. 6 showing the machine in a collapsed storage configuration.

In addition to a capability for vertical height adjustability of the leg support beam 2 along slide shaft 66, it is preferred that the beam mounting means 59 further facilitate variable angular positioning of the leg support beam 2. Such additional dimension of adjustability advantageously accommodates physical therapy patients having varying ranges of knee and leg motion. The angular positioning function of the beam mounting means 59 is preferably facilitated by a first pivot joint 82 which incorporates pin 86 and clevis 83,84 joint components which pivotally or hingedly mount the lower end of slide shaft 66 via housing 76 to the forward end of base 64. Though the instant invention's angular positioning means may suitably comprise other commonly known angular positioning joints such as a locking pivot joint, the instant invention's angular positioning means preferably comprise a triangulating brace which, referring to FIG. 2, is referred to generally by Reference Arrow 99. In a preferred embodiment, the triangulating brace 99 is configured as the telescoping shaft 98,100 which includes an upper slide sleeve or quill section 98 and a lower slide shaft section 100. A pin 104 and alignable eye series 102 combination incorporated within the telescoping shaft 98,100 allows such shaft to be alternatively fixed at a desired length and to be adjustably reconfigured at a shorter or longer length. The upper end of the telescoping shaft 98,100 is preferably pivotally attached to the upper end of the slide shaft 66 by a second pivot joint which, referring to FIGS. 2 and 4, comprises an axle pin 92 and clevis 90 joint. Referring further to FIG. 6, such second pivot joint 92,90 advantageously facilitates pivoting of the telescoping shaft 98,100 to the depicted forwardly folded configuration wherein the telescoping shaft 98,100 compactly underlies and extends substantially parallel to with the leg support beam 2. Alternatively, the telescoping shaft 98,100 may counter-pivot about the second pivot joint 90,92 from the compact folded position of FIG. 6 to the bracing and leg support beam supporting position of FIG. 2.

Figure 3:
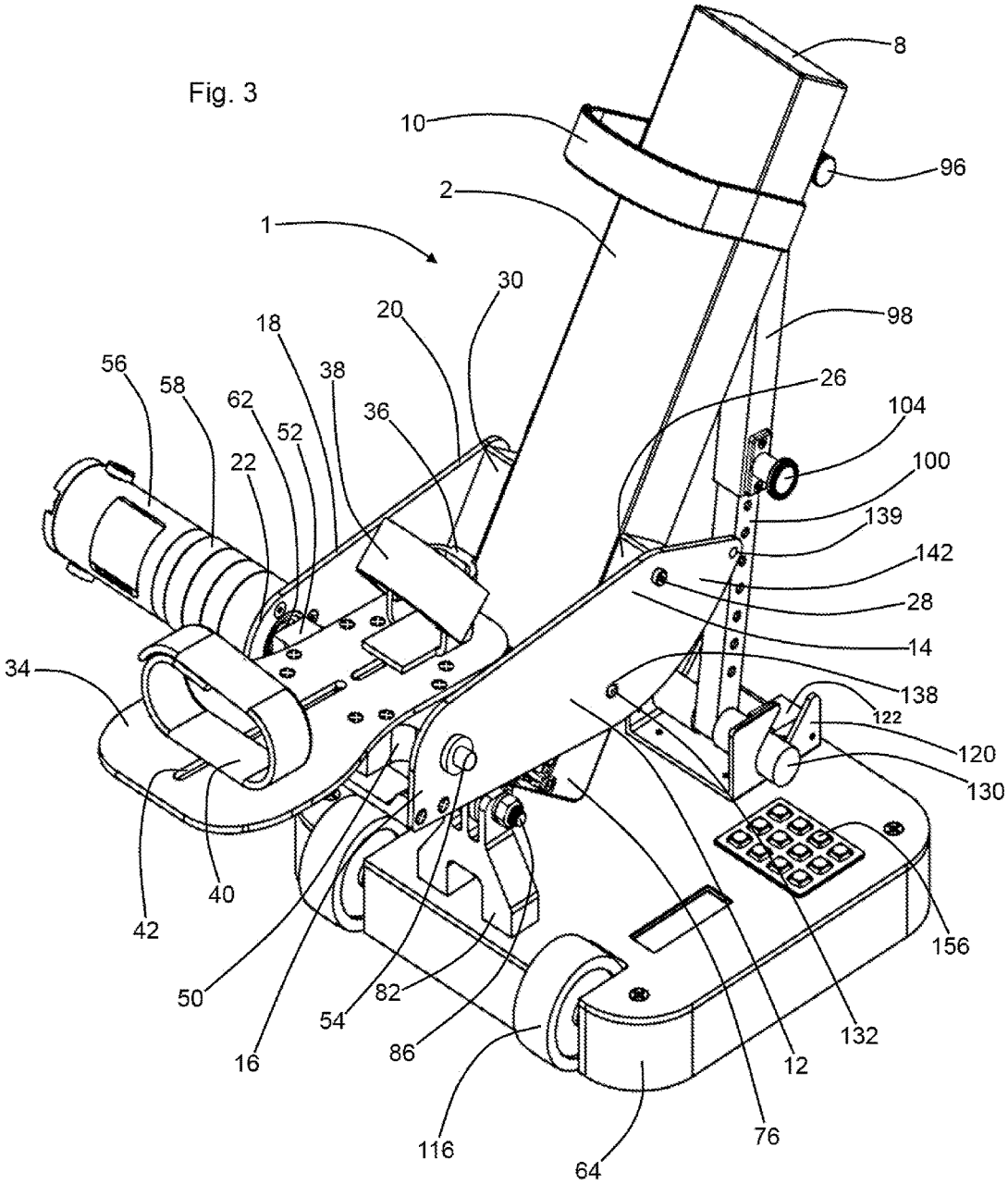
FIG. 3 redepicts the machine of FIG. 1, the view of FIG. 3 showing leg and foot engaging components at a downwardly retracted position.
Figure 4:
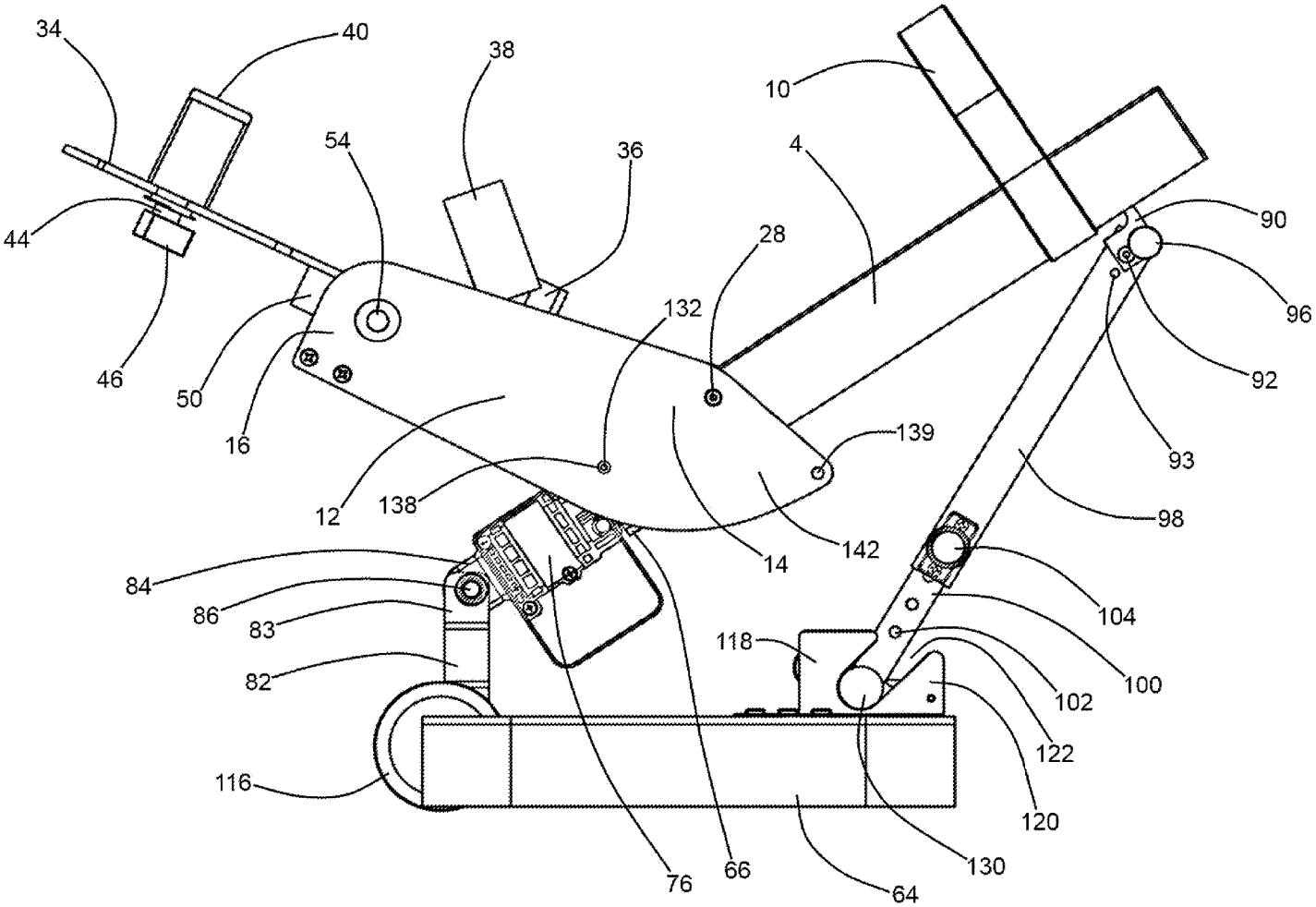
FIG. 4 is a side view of the machine of FIG. 3, the view showing rearward angular adjustment of the leg and foot engaging components.

Referring to FIGS. 3 and 4, in order to adjust the angle of the leg support beam 2 with respect to the base 64, an operator may simply laterally withdraw pin 104, releasing sleeve 98 for vertical sliding movement with respect to slide shaft 100. Such sliding movement may alter the position of the leg support beam 2, for example, from angular position of FIG. 3 to the angular position of FIG. 4.

Referring simultaneously to FIGS. 2 and 6, upon forward folding and pivoting of the telescoping shaft 98,100, about the second pivot joint 90,92, to the folded position of FIG. 6, the leg support beam 2 and the slide shaft 66 are freed to rearwardly pivot from the use position depicted in FIG. 2 to the collapsed position depicted in FIG. 6. Referring further simultaneously to FIG. 5, upon pivoting of leg support beam 2 to such collapsed position, a latch tab 108 fixedly attached to the side wall 6 of leg support beam 2 may contact, trip against, and may engage an inner end of a releasable pull pin 114 mounted upon side flange 124 of bracket 118, such engagement causing such pin to enter and releasably lock within bolt hole 110. Upon such collapsing pivoting of the leg support beam 2 to the compact position of FIG. 6, retainer tab 112 laterally stabilizes the leg support beam 2, while the latch 108,110,114 resists upward counter-pivoting motion of the leg support beam 2 away from base 64. Referring to FIGS. 2, 6, and 7, the bracket 118 which is fixedly mounted to the upper surface of base 64 is preferably configured for service as releasable a mounting means capable of alternatively holding the telescoping shaft 98,100 at the FIG. 2 bracing position, and releasing such shaft for forward or rearward pivoting movement either to the compact folded configuration of FIG. 6 or to FIG. 7's pull cart configuration. A "T" handle 130 mounted upon the lower or distal end of the telescoping shaft 98,100 multiply functions as a pull handle in the cart configuration of FIG. 7, as a releasable mounting means component, and as a pivot joint component. Upon pivoting of the telescoping shaft 98,100 to the bracing configuration of FIG. 2, the left and right arms of the "T" handle 130 may be captured within "U" shaped rotary bearing slots 122 and 126 which are defined within lateral flanges 120 and 124 of the bracket 118. While the "T" handle 130 occupies such captured position within slots 122 and 126, a latch 128 may securely hold the "T" handle 130 at its bracing position as a safety against accidental collapse of the machine.

Upon release of the "T" handle 130 from bracket 118, the telescoping shaft 98,100 is freed to rearwardly pivot from the bracing position depicted in FIG. 2 to the rearwardly extended pull cart position depicted in FIG. 7, such pivoting motion being about pivot pin 92. Referring simultaneously to FIGS. 4 and 7, upon such pivoting motion of the telescoping shaft 98,100, a laterally opening eye within the upper end of slide sleeve 98 may orbitally move into alignment with a pull pin 96 mounted upon clevis mount 90, and upon such alignment, pin 96 may releasably engage eye 93 for securing the handle 130 and the telescoping shaft 98,100 in the FIG. 7 extended pull cart configuration. Referring simultaneously to FIGS. 4-7, in order to facilitate and compliment the FIG. 7 pull cart configuration of the machine 1, wheels or rollers 116 are preferably rotatably mounted upon the forward end of the base 64. Upon configuration of the machine 1 for rolling transport in the manner of a pull cart, and upon upwardly raising the "T" handle 130, latch 108,110,114 advantageously holds the base 64 in alignment with the leg support beam 2, allowing the entire unit to be conveniently rolled along hospital and clinic floors.

In either the collapsed configuration of FIG. 6 or the pull cart configuration of FIG. 7, it is desirable that the support arm 12,18, foot plate 34, and motor 56 assembly pivot to a compact storage configuration, as shown in FIGS. 6 and 7, rather than remain in their cantilevered use configuration. To facilitate such collapsing function, the support arm 12,18 including its attached components preferably pivot about, referring further simultaneously to FIGS. 1 and 5, pivot pins 28 and 32 between the cantilevered use position of FIG. 1 and the compact storage position of FIGS. 6 and 7. In the cantilevered use position of FIGS. 1 and 5, a spring biased latch pin 132 mounted for leftwardly extension from mounting block 26 may engage latch eye 138 at the proximal end 14 of arm 12 while a fixed pin 140 which extends rightwardly from mounting block 30 correspondingly engages slot 134 within the proximal end 20 of arm 18. Such engagements of pin 132 within eye 138, and pin 140 within slot 134 may securely hold the support arm 12,18 at its forwardly cantilevered use position.

Manual inward depression of the pin 132 releases such pin from eye 138, freeing the support arm 12,18 for dorsiflecting or back folding pivoting motion from the cantilevered use position of FIGS. 1-5 to the compact storage or pull cart position of FIG. 6 or 7. Upon such pivoting of the support arm 12,18 to the position of either FIG. 6 or FIG. 7, pin 132 may enter and engage a differently angularly positioned eye 139 at the end of proximal arm extension 142. Such alternative engagement of pin 132 with eye 139 advantageously releasably holds the support arm 12,18 at such backfolded compact configuration.

Referring simultaneously to FIGS. 2 and 5, a matrix of electrically conductive wires (not depicted within views) are preferably provided for operatively electrically interconnecting the servomotor 56, the electric motor 74, and an electronic controller 63 housed within the interior 65 of the base 64, such wire matrix electrically communicating with such components at plug adapter ports 60, 61, and 78, and 79. The base 64 preferably further houses and supports an AC power port 150, an on/off switch 152, and an electric cooling fan 160 which draws cooling air into the interior 65 of base 64 to cool internal components and to emit at exhaust port 154. In a preferred embodiment, the electronic controller 64 is adapted for facilitating programmed control of the speed and/or power output of motor 56, the direction of turn of such motor, timing and sequences of the motor's operation, and angular position rotation counting of the motor's output shaft. Such electronic motor control advantageously translates into precise and programmable control of the pivoting and counter-pivoting motions of the foot plate 34.

In the preferred embodiment, user input keys 156 and a read-out screen 158 are provided for facilitating user programming and control of the electronic control unit 63 and of the motion of foot plate 34.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A foot flexion and extension machine comprising:

(a) a leg support beam having upper and lower ends;

(b) a support arm having proximal and distal ends;

(c) arm mounting means interconnecting the lower end of the leg support beam and the proximal end of the support arm;

(d) a foot plate;

(e) plate mounting means interconnecting the foot plate and the distal end of the support arm, the plate mounting means being adapted for facilitating pivoting movement of the foot plate;

(f) first motor means connected operatively to the foot plate, the first motor means being adapted for driving the pivoting movement of the foot plate;

(g) a base; and (h) beam mounting means interconnecting the leg support beam and the base.

2. The foot flexion and extension machine of claim 1 wherein the beam mounting means comprise a slide shaft having upper and lower ends, the leg support beam being slidably mounted upon the slide shaft, and further comprising height adjusting means operatively interconnecting the leg support beam and the slide shaft for alternatively upwardly and downwardly moving the leg support beam, the support arm, and the foot plate.

3. The foot flexion and extension machine of claim 2 wherein the height adjusting means comprise a linear motion actuator.

4. The foot flexion and extension machine of claim 3 wherein the linear motion actuator comprises a jack screw assembly.

5. The foot flexion and extension machine of claim 4 further comprising second motor means connected operatively to the jack screw actuator.

6. The foot flexion and extension machine of claim 3 wherein the beam mounting means further comprise angular positioning means connected operatively to the slide shaft, the angular positioning means comprising a first pivot joint interconnecting the base and the slide shaft's lower end.

7. The foot flexion and extension machine of claim 6 wherein the angular positioning means comprise a second pivot joint and a triangulating brace having upper and lower ends, the second pivot joint interconnecting the upper end of the triangulating brace and the upper end of the slide shaft.

8. The foot flexion and extension machine of claim 7 wherein the triangulating brace comprises a telescoping shaft.

9. The foot flexion and extension machine of claim 8 wherein the angular positioning means are adapted for facilitating pivoting movements of the slide shaft and the leg support beam between collapsed and use positions, the slide shaft and leg support beam extending along the base while in their collapsed positions, and the slide shaft and leg support beam being angularly upwardly displaced from their collapsed positions while in their use positions.

10. The foot flexion and extension machine of claim 9 further comprising a first latch connected operatively to the base, the first latch being adapted for, upon the pivoting movement of the slide shaft and leg support beam to their collapsed positions, resisting counter-pivoting movements of the slide shaft and the leg support beam to their use positions.

11. The foot flexion and extension machine of claim 10 wherein the second pivot joint is adapted for facilitating pivoting of the telescoping shaft between folded and bracing positions, the telescoping shaft extending along the slide shaft while in the folded position, and the telescoping shaft extending upwardly from the base while in the bracing position.

12. The foot flexion and extension machine of claim 11 wherein the base has a forward end and further comprising a pair of wheels mounted rotatably upon forward end of the base, and wherein the first pivot joint forwardly positions the lower end of the slide shaft upon the base.

13. The foot flexion and extension machine of claim 12 further comprising releasable mounting means fixedly attached to the base, the releasable mounting means being adapted for, upon the pivoting of the telescoping shaft to the bracing position, resisting pivoting of the telescoping shaft away from the bracing position.

14. The foot flexion and extension machine of claim 13 further comprising a handle fixedly attached to a lower end of the telescoping shaft, the releasable mounting means being adapted for engaging the handle.

15. The foot flexion and extension machine of claim 14 wherein the second pivot joint is further adapted for facilitating rearward pivoting of the telescoping shaft to a cart handle position.

16. The foot flexion and extension machine of claim 9 wherein the arm mounting means comprise a third pivot joint adapted for facilitating pivoting of the support arm between a foot support position and a storage positioning, the support arm cantilevering from the leg support beam while in the foot support position, and the support arm extending along the leg support beam while in the storage position.

17. The foot flexion and extension machine of claim 16 further comprising a second latch adapted for, upon the pivoting of the support arm to the foot support position, resisting pivoting of the support arm away from the foot support position.

18. The foot flexion and extension machine of claim 17 wherein the second latch is further adapted for, upon the pivoting of the support arm to the storage position, resisting pivoting of the support arm away from the storage position.

19. The foot flexion and extension machine of claim 5 wherein the first motor means comprises a first reversible electric motor, and wherein the second motor means comprises a second reversible electric motor.

20. The foot flexion and extension machine of claim 19 further comprising an electronic controller adapted for motor control, a matrix of electrically conductive wires operatively interconnecting the first reversible electric motor, the second reversible electric motor, and the electronic controller, and a hollow space defined within the base, the electronic controller being housed within the hollow space.

* * * * *